US012104330B2

(12) United States Patent
Springer

(10) Patent No.: US 12,104,330 B2
(45) Date of Patent: Oct. 1, 2024

(54) METHOD AND TRACK MAINTENANCE MACHINE FOR TREATMENT OF A BALLAST TRACK

(71) Applicant: Plasser & Theurer Export von Bahnbaumaschinen Gesellschaft m.b.H., Vienna (AT)

(72) Inventor: Heinz Springer, Tokyo (JP)

(73) Assignee: Plasser & Theurer Export von Bahnbaumaschinen Gesellschaft m.b.H., Vienna (AT)

( * ) Notice: Subject to any disclaimer, the term of this patent is extended or adjusted under 35 U.S.C. 154(b) by 779 days.

(21) Appl. No.: 17/299,547

(22) PCT Filed: Dec. 2, 2019

(86) PCT No.: PCT/EP2019/083209
§ 371 (c)(1),
(2) Date: Jun. 3, 2021

(87) PCT Pub. No.: WO2020/135973
PCT Pub. Date: Jul. 2, 2020

(65) Prior Publication Data

US 2022/0025585 A1 Jan. 27, 2022

(30) Foreign Application Priority Data

Dec. 27, 2018 (AT) ..... A 390/2018

(51) Int. Cl.
*E01B 27/17* (2006.01)
*E01B 27/02* (2006.01)
*E01B 29/04* (2006.01)

(52) U.S. Cl.
CPC ..... *E01B 27/17* (2013.01); *E01B 27/026* (2013.01); *E01B 29/04* (2013.01); *E01B 2203/10* (2013.01); *E01B 2203/12* (2013.01)

(58) Field of Classification Search
CPC ..... E01B 27/17; E01B 27/20; E01B 27/16; E01B 27/026; E01B 29/04; E01B 2203/10; E01B 2203/12
See application file for complete search history.

(56) References Cited

U.S. PATENT DOCUMENTS 3,111,909 A * 11/1963 Plasser ..... E01B 27/12 188/1.11 R
4,881,467 A * 11/1989 Theurer ..... E01B 27/17 104/7.2

(Continued)

FOREIGN PATENT DOCUMENTS

AT 201640 B 1/1959
AT 400 862 B 4/1996

(Continued)

OTHER PUBLICATIONS

Chinese Office Action in Chinese Application No. 201980083775.0 dated Sep. 5, 2022.

(Continued)

*Primary Examiner* — Zachary L Kuhfuss
*Assistant Examiner* — Cheng Lin
(74) *Attorney, Agent, or Firm* — Collard & Roe, P.C.

(57) ABSTRACT

The invention relates to a method for treatment of a ballast track by means of track maintenance machine which comprises a lifting unit, having gripping rollers for gripping a track grid formed of rails and sleepers and lifting drives for lifting the track grid, and a measuring system for comparing to a target position of the track, wherein the lifting unit is set in vibration by means of a vibration exciter and the vibration is transmitted to the track grid, wherein the lifting unit is controlled by means of a control device in such a way that, during a lifting operation, the lifting unit is set in vibration, and the track grid is first lifted to above the target position and subsequently lowered to the target position. By means of (Continued)

the method according to the invention it is possible to carry out in a simple manner a lifting of the track grid with simultaneous stabilization of the track position.

9 Claims, 2 Drawing Sheets

(56) References Cited

U.S. PATENT DOCUMENTS

| | | | | | |
|---|---|---|---|---|---|
| 4,903,609 | A | * | 2/1990 | Isakov | E01B 27/16 104/10 |
| 5,205,218 | A | * | 4/1993 | Theurer | E01B 27/16 104/12 |
| 10,260,203 | B2 | * | 4/2019 | Lintz | E01B 27/20 |
| 10,421,101 | B2 | * | 9/2019 | Hoefler | E01B 27/16 |
| 10,550,525 | B2 | * | 2/2020 | Lichtberger | E01B 35/06 |
| 10,563,358 | B2 | * | 2/2020 | Hoefler | E01B 27/16 |
| 10,633,801 | B2 | * | 4/2020 | Steiner | E01B 27/16 |
| 10,829,897 | B2 | * | 11/2020 | Springer | E01B 27/17 |
| 2019/0271120 | A1 | | 9/2019 | Springer | |

FOREIGN PATENT DOCUMENTS

| | | | | | |
|---|---|---|---|---|---|
| AT | 516873 | B1 | | 12/2016 | |
| AU | 2004325170 | B2 | | 2/2010 | |
| CA | 1082521 | A | | 7/1980 | |
| CN | 107208383 | A | | 9/2017 | |
| CN | 108291371 | A | | 7/2018 | |
| EP | 0 518 845 | A1 | | 12/1992 | |
| GB | 2094379 | A | * | 9/1982 | E01B 27/13 |
| GB | 2267305 | A | | 12/1993 | |
| WO | 2006/056215 | A1 | | 6/2006 | |
| WO | 2017/092840 | A1 | | 6/2017 | |

OTHER PUBLICATIONS

International Search Report in Application No. PCT/EP2019/083209 mailed Feb. 24, 2020.

Austrian Search Report in Austrian Application No. A 390/2018 dated Dec. 27, 2018.

* cited by examiner

METHOD AND TRACK MAINTENANCE MACHINE FOR TREATMENT OF A BALLAST TRACK

CROSS REFERENCE TO RELATED APPLICATIONS

This application is the National Stage of PCT/EP2019/083209 filed on Dec. 2, 2019, which claims priority under 35 U.S.C. § 119 of Austrian Application No. A 390/2018 filed on Dec. 27, 2018, the disclosure of which is incorporated by reference. The international application under PCT article 21 (2) was not published in English.

FIELD OF TECHNOLOGY

The invention relates to a method for treatment of a ballast track by means of a track maintenance machine which comprises a lifting unit having gripping rollers for gripping a track grid formed of rails and sleepers and lifting drives for lifting the track grid, and a measuring system for comparing to a target position of the track, wherein the lifting unit is set in vibration by means of a vibration exciter and the vibration is transmitted to the track grid. In addition, the invention relates to a corresponding track maintenance machine.

PRIOR ART

According to WO 2017/092840 A1, a tamping machine is known which has a lifting-lining unit that can be set in vibrations by means of a vibration exciter. The machine serves for implementing a method in which a track is treated in two working passes. In a first working pass, the track is lifted to a target level in the conventional way by means of the lifting-lining unit and tamped by means of tamping units. During this lifting-lining operation, the vibration exciter of the lifting-lining unit remains shut off. In a subsequent working pass, the track maintenance machine travels over the same stretch of track a second time. During this, the vibration exciter is activated and the lifting-lining unit is used as a stabilizing unit.

SUMMARY OF THE INVENTION

It is the object of the invention to improve a track treatment by means of a lifting unit of the kind mentioned at the beginning. In addition, a track maintenance machine optimized for the improved method is to be shown.

According to the invention, these objects are achieved by way of the features of claims 1 and 7. Advantageous further developments of the invention become apparent from the dependent claims.

In this, the lifting unit is controlled by means of a control device in such a way that, during a lifting operation, the lifting unit is set in vibration, and the track grid is first lifted to above the target position and subsequently lowered to the target position. In the effective area of the lifting unit, cavities occur initially under the sleepers during the lifting. These are filled with ballast during the lifting operation already, since the vibrations transmitted to the track grid put the ballast in a fluid-like state. Particularly the ballast stones located next to and on top of the sleepers start to move and wander downward into the emerging cavities. This combined lifting- and vibrating motion continues on beyond the target position, so that enough ballast gets under the sleepers. To reach the target position, the vibrating lifting unit is subsequently pressed downward. During this, the ballast which has gotten into the cavities is consolidated and forms a stable support for the sleepers. Favourably, horizontal vibrations in the transverse direction of the track are transmitted to the track grid in order to achieve an effective consolidation of the ballast. With the method according to the invention, it is possible to carry out in a simple manner a lifting of the track grid with simultaneous stabilization of the track position.

In an improved variant of the method, the lifting operation is interrupted at least once by lowering the vibrating lifting unit. In this, a pre-consolidation of the ballast already moved under the sleepers takes place. This increases the cavity volume under the sleepers when the lifting operation is continued, so that more ballast gets under the sleepers over the entire course of the lifting operation.

A further development of the method provides that the lifting unit has lining drives by means of which the track grid is aligned, and that—during a lining operation—the vibration of the lifting unit is reduced. In this embodiment, the lifting unit fulfils the function of a lifting-lining unit. During lifting- and lowering motions, interfering retroactive effects of the vibrating unit on a machine frame can be neglected since the movably mounted vertical drives have a vibration-damping effect. This is different in the case of a lining motion taking place in the transverse direction of the track. When the lining drives are activated, a free pendulum motion of the lifting unit in the transverse direction of the track is not possible because lining forces act between the lifting unit and the machine frame. An interfering transmission of vibrations to the machine frame is prevented by reducing the vibration of the lifting unit. Ideally, the vibration is shut off entirely while the lining drives are activated.

In an advantageous extension of the method, ballast is placed on the track grid in a preceding working step. This takes place either by way of the same track maintenance machine or by means of another machine, for instance by means of a ballast plough. In particular, the ballast pre-deposited on the sleepers is set in motion by the transmitted vibrations and fills the hollows and cavities forming during the lifting operation. In this way, a sufficient amount of ballast flowing in is available for the filling operations in order to achieve high lifting values with the present method.

In this, it is favourable if new or cleaned ballast is placed on the track grid. The high-quality ballast is at first very mobile and promotes the shifting of the ballast stones set in vibration. After compaction, however, there is a very stable structure which is not impaired by dirt or abrasives. Thus, a desired high resistance to transverse displacement of the sleepers embedded in the ballast is achieved.

A further improvement provides that in a subsequent working step, sleepers of the track grid are tamped by means of a tamping unit. The ballast pre-consolidated by means of the vibrating lifting unit is brought under the respective sleeper even more efficiently by way of the tamping unit. During this, the lifting unit keeps the track grid in the target position. Due to the pre-consolidation of the ballast, a better consolidation can be achieved with fewer tamping cycles as compared to conventional tamping methods.

The track maintenance machine, according to the invention, for treatment of a ballast track comprises a lifting unit, having gripping rollers for gripping a track grid and lifting drives for lifting the track grid, wherein the lifting unit is coupled to a vibration exciter. The machine also comprises a measuring system for comparing the lifting level to a target position of the track during a lifting operation. In addition, a control device is arranged which is designed for actuating the lifting unit as per one of the described methods. This novel actuation of the lifting unit enables a consolidation or pre-consolidation of the ballast already during a lifting operation.

Advantageously, the vibration exciter has an adjustment device for setting an impact force acting by the lifting unit on the track grid. With this, the vibration transmitted to the track grid can be adapted to the prevailing requirements. It is useful particularly during a lining operation to reduce the transmitted vibration in each case order to decrease the impact force. In addition, the adjustable impact force can be used for regulated lowering of the track grid. In this, a stronger impact force with the same vertical load leads to a faster lowering of the track grid.

In a further advantageous embodiment, a tamping unit is arranged rearward of the lifting unit, with regard to a working direction, on a machine frame or a satellite frame. With this, a multistage compaction is enabled in one working pass, wherein the lifting unit effects a pre-compaction, and the tamping unit effects an additional compaction.

Another advantageous embodiment provides that a stabilizing unit is arranged rearward of the lifting unit with regard to a working direction. Such a combination is favourable for new track installations or after ballast cleaning. The track is lifted to a desired target position by means of the measuring system and the lifting unit set in vibrations, and is pre-consolidated. Subsequently, the ballast is further consolidated by means of the stabilizing unit. With this layered compaction and simultaneous position correction, drive clearances up to a prescribed allowable speed are possible even without the use of a tamping unit.

BRIEF DESCRIPTION OF THE DRAWINGS

The invention will be described below by way of example with reference to the accompanying drawings. There is shown in a schematic manner in.

DESCRIPTION OF THE EMBODIMENTS

Figure 1:
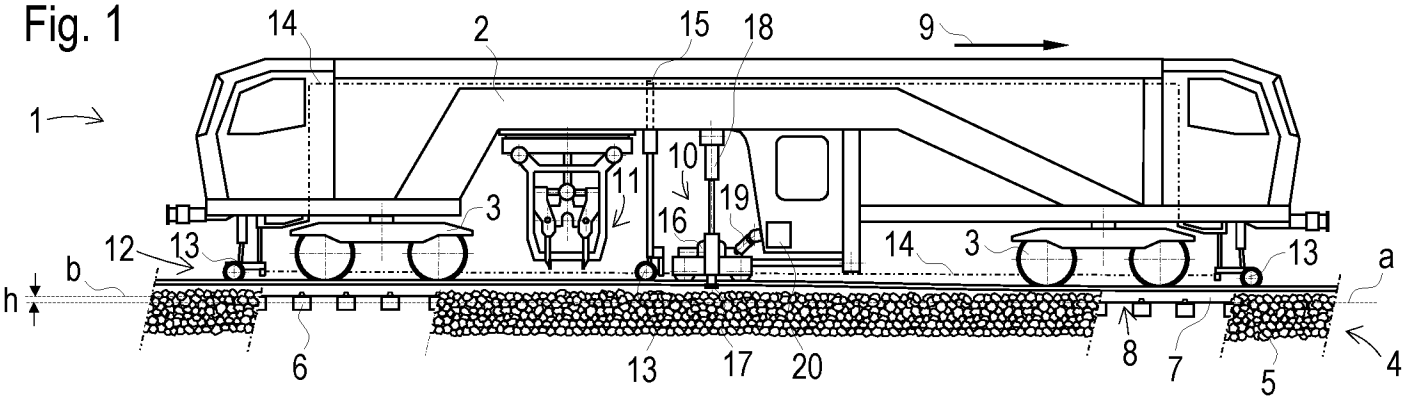
FIG. 1 a track maintenance machine with lifting unit and tamping unit

The track maintenance machine 1 in FIG. 1 comprises a machine frame 2 which, supported on on-track undercarriages 3, is mobile on a track 4. The track 4 is a ballast track in which sleepers 6, supported on ballast 5, and rails 7 connected thereto form a track grid 8. A tamping unit 11 is arranged to the rear of a lifting unit 10, with regard to a working direction 9. A measuring system 12 comprises, for example, three measuring trolleys 13 which, during the track treatment, record a track position relative to a reference system 14. Used as reference system 14 are either mechanically stretched measuring chords or optical devices.

A mechanical measuring system 12 comprises two levelling chords (one for each rail) and a lining chord. The chords are stretched between the two outer measuring trolleys 13, and a measuring sensor 15 is located at the central measuring trolley. In an optical measuring system 12, light sources and optical sensors are arranged on the measuring trolleys 13, by means of which the positions of the measuring trolleys 13 relative to one another are recorded. In the present invention, the measuring system 12 is used to lift the track grid 8 up to a desired level by means of the lifting unit 10 set in vibration.

According to the invention, the lifting unit 10 comprises a vibration exciter 16. The latter is preferably designed so that, when the vibration exciter 16 is activated, the lifting unit 10 is set in a horizontal vibration transversely to the longitudinal direction of the machine. For example, two rotating imbalances are arranged, the impact forces of which amplify one another in horizontal direction and cancel one another in vertical direction. In this, it is favourable if the resulting impact force is adjustable. Provided for that purpose are either at least four imbalances with phase positions adjustable to one another, or imbalances having an adjustable eccentricity of the center of mass. With the adjustable impact force, the vibration of the lifting unit 10 can be adapted to optimized specifications without delay.

For lifting the track grid 8, the lifting unit 10 comprises gripping rollers 17 which grip the rail heads during operation and are designed to roll along the rails 7. Used as gripping rollers 17 are flanged rollers and rollers arranged on roller tongs. The flanged rollers are pressed against the inner rail edges by means of telescopic axles. The roller tongs enclose the rail heads from the outside.

By means of the gripping rollers 17, all the movements of the lifting unit 10 are transmitted to the gripped track grid 8. For the purpose of lifting and lowering the track grid 8, the lifting unit 10 has lifting drives 18 which are connected to the machine frame 2 and are able to carry out lateral pendulum motions. As a result, the horizontal vibration of the lifting unit 10 is not transmitted to the machine frame 2.

Usefully, the lifting unit 10 also fulfils the function of track lining. During this, the track 4 is brought into the desired position laterally. Upon activation of the lining drives 19 required for this purpose, these cause a lateral displacement of the lifting unit 10 relative to the machine frame 2. Thus, there is a lateral transmission of force between the lifting unit 10 and the machine frame 2 during a lining operation. In order to avoid an interfering transmission of vibrations onto the machine frame 2 during this, the vibration exciter 16 is deactivated during lining of the track. A reduction of the impact force by adjusting the vibration-generating imbalances is also sufficient.

The lifting unit 10 is controlled by means of a control device 20. In this control device 20, a control sequence for the lifting unit 10 is set up. Upon activation of the sequence, in at least one phase of the sequence a lifting of the vibrating lifting unit 10 to above a target position of the track 4 takes place. A comparison of the momentary position of the track grid 8 to the target position during the lifting operation takes place by means of the measuring system 12.

Figure 2:
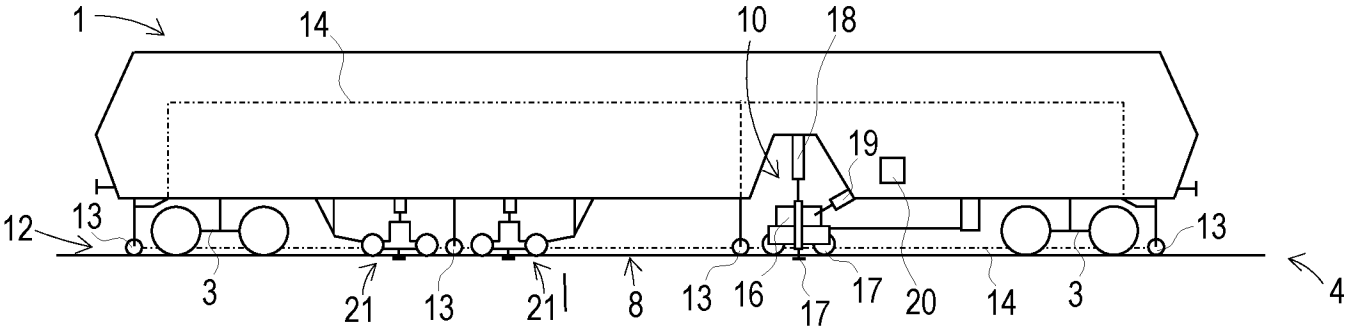
FIG. 2 a track maintenance machine with lifting unit and stabilizing unit
Figure 3:
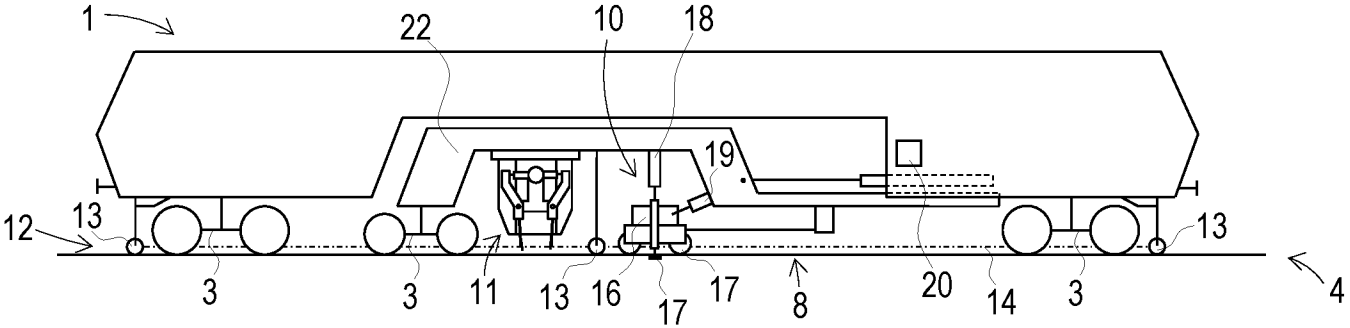
FIG. 3 a track maintenance machine with a satellite frame

FIGS. 2 and 3 show further advantageous embodiments of a track maintenance machine 1 by means of which the method according to the invention can be implemented in an optimized manner. In FIG. 2, a stabilizing unit 21 is arranged to the rear of the lifting unit 10 in the working direction 9. With this, a continuous track treatment takes place. After lifting the track by means of the lifting unit 10, the track 4 is stabilized by means of the stabilizing unit 21.

The track maintenance machine 1 in FIG. 3 is designed as a continuously working tamping machine. In this, the machine 1 moves continuously along the track 4. A satellite 22 with the lifting unit 10 and the tamping unit 11 is moved cyclically forward and backward relative to the machine frame 2 in order to position the tamping unit 11 above the respective sleeper 6 for the tamping operation.

Figure 4:
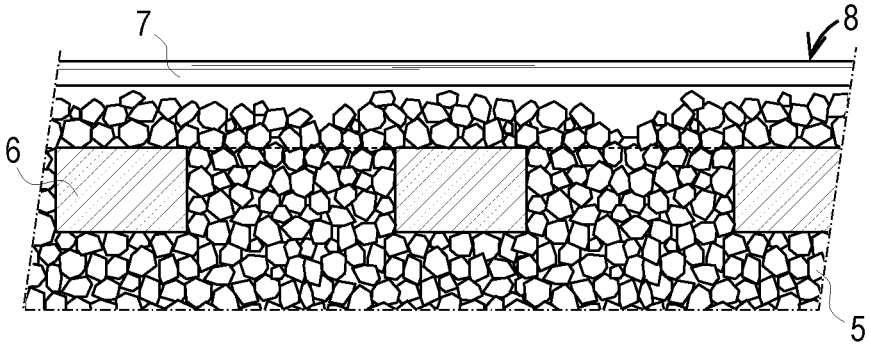
FIG. 4 a longitudinal section of a ballasted track grid
Figure 5:
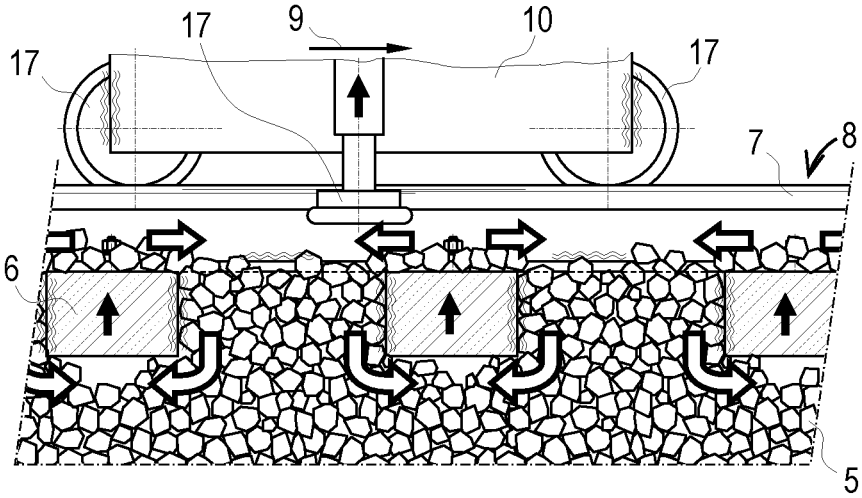
FIG. 5 a track grid according to FIG. 4 during track grid lifting

The working mode of the lifting unit 10 is explained with the aid of the further FIGS. 4-7. At the start, the track grid 8 is covered with ballast 5 (FIG. 4). For example, ballast 5 has been shifted from an embankment slope in the direction of the rails 7 by means of a ballast plough. During a forward motion of the machine, the track grid 8 is lifted by means of the lifting unit 10 set in vibration, during which the vibrations are transmitted to the ballast 5. Commencing with a vibration frequency of about 30 Hz, the ballast 5 set in vibration shows a behaviour similar to that of a fluid medium. For that reason, the cavities which form under the sleepers 6 during the lifting operation are immediately filled up by moving ballast stones (FIG. 5).

Figure 6:
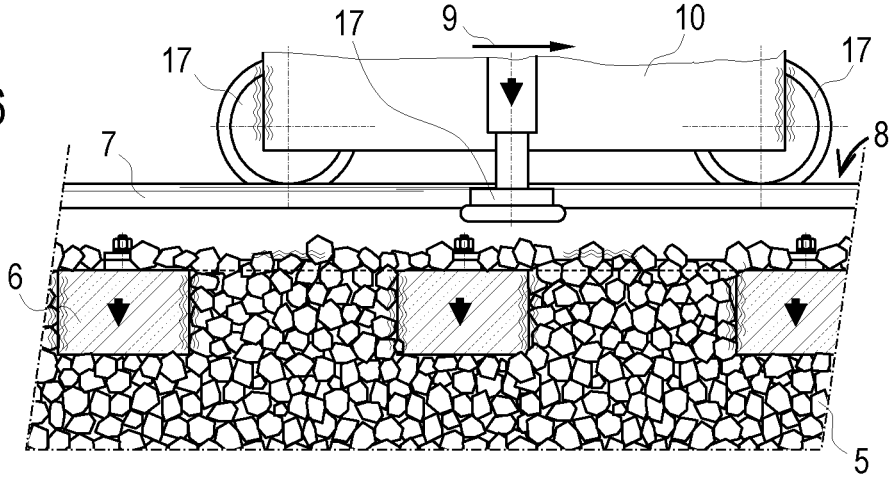
FIG. 6 a track grid according to FIG. 4 during track grid lowering

A subsequent downward motion of the lifting unit 10, still set in vibration, causes a consolidation of the ballast 5 moved under the sleepers 6 (FIG. 6). A lesser impact force as compared to a conventional stabilizing unit 21 is sufficient. Thus, smaller imbalances than in a stabilizing unit 21 are provided in the vibration exciter 16. A vibration frequency in the range of 35 Hz to 50 Hz is optimal during both the lifting operation and the lowering motion.

The invention covers several working methods with and without a tamping unit 11. When using the lifting unit 10 as a lifting-lining unit during a tamping operation, the following method steps are applied. At the start of working, the lifting unit 10 is lowered onto the track 4. By means of telescopic axles, the flanged rollers are pressed apart and the roller tongs are pressed against the rails 7. Thereafter, the vibration exciter 16 is activated, and the lifting unit 10 as well as the gripped track grid 8 start to vibrate. During this, the lifting unit 10 is initially held in position via the measuring system 12 in order to avoid an unwanted lowering of the track 4.

During a forward motion with the track maintenance machine 1, the lifting unit 10 with the gripped track grid 8 is lifted several times and lowered in between. This pulsing lifting operation is carried out by means of the lifting drives 18, wherein a continuous comparison of the momentary track position to a prescribed target track position is carried out by means of the measuring system 12.

Figure 7:
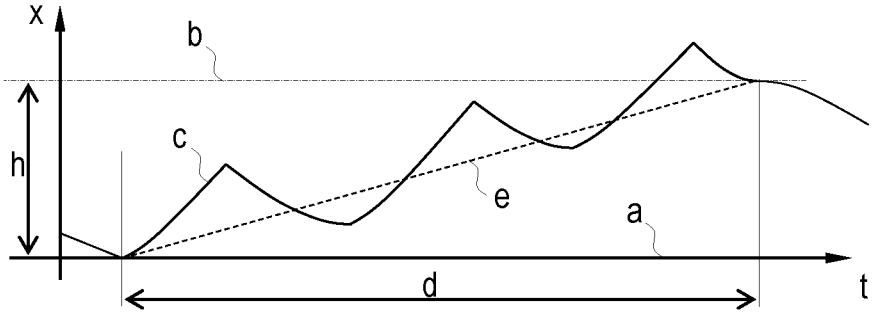
FIG. 7 a progress of motion during a lifting operation.

Shown in FIG. 7 is a level change (solid line c) of the track grid 8 in vertical direction z over the time t during a lifting operation. For the duration d of a lifting operation, the track grid 8 is to be lifted with a lifting value h from an initial position a to a prescribed target level b. The target level b corresponds to the target position of the track 4 in vertical direction z. With the machine 1 moving further forward, the lifting unit 10 follows the course of the track grid, and—starting from the initial position a—a new lifting operation begins.

In the present example, the track lifting is subdivided into three sections. In each section, the track grid 8 is first over-lifted relative to a virtual linear track lift (dashed line e). A corresponding over-lift value is stored in the control device 20, for example. The objective of this over-lifting is a sufficient introduction of ballast under the lifted sleepers 6. In this, it is favourable if the extent of the over-lift is adjustable in order to adapt to the ballast condition and the desired overall lift.

The lifting operation is interrupted in each section by lowering the vibrating lifting unit 10. During this, it may be intended in the first sections that a level corresponding to a linear track lifting (dashed line e) is gone below. This intensifies the intermediate consolidation of the ballast 5 and enlarges the fillable cavities during the following lifting of the track grid. Via the lifting drives 18, a vertical load can be set with which the lifting unit 10 presses onto the track grid 8 during a lowering phase. Vertical load, impact power and vibration frequency of the lifting unit 10 as well as the duration of lowering determine the compaction of the ballast 5 under the sleepers. An adjustment of these parameters leads to an optimization of the respective consolidation operation in dependence on the ballast quality.

At least in the final section of the lifting operation, a lifting of the track grid 8 above the target level b takes place with a subsequent lowering to the target position. This happens by way of a continuous comparison by means of the measuring system 12. In the simplest case, a straight line is prescribed as target position for each rail in order to equalize relative track position faults. An improved track position correction takes place by prescribing an absolute target position. To that end, a survey of the actual position with regard to specified fixed points takes place prior to the track treatment. Based on this, the optimal target position is derived while taking into account various specifications and general conditions.

During the actual tamping operation, the lifting unit 10 keeps the track grid 8 in the position prescribed by the measuring system 12. During this, the already pre-consolidated ballast 5 can be brought under the sleepers 6 in a more efficient way by means of the tamping unit 11 and can be further consolidated there. As a result of the pre-consolidation of the ballast 5, fewer tamping cycles as compared to a conventional tamping unit are necessary in order to achieve a prescribed degree of consolidation. Moreover, the combined consolidation operations by means of the lifting unit 10 and the tamping unit 11 lead to improved consolidation results.

With the present invention, a track lifting without the use of a tamping unit 11 is possible particularly in the case of new track construction or after ballast cleaning. This variant of the method is suited for ballast cleaning machines and track relaying machines. Here also, a comparison to the target position takes place by means of the measuring system 12.

At the start of work, the lifting unit 10 is lowered onto the track 4. Via the gripping rollers 17, the lifting unit 10 connects itself to the track grid 8. The activated vibration exciter 16 sets the lifting unit 10 and the gripped track grid 8 in vibration, wherein an undesired lowering is prevented via the measuring system 12. As soon as the track maintenance machine 1 moves in the working direction 9, the lifting unit 10 starts with a pulsing lifting-lowering motion. During this, as described above, the lifting operation is interrupted by lowering phases. The result is a process in which lifting phases and lowering phases alternate continuously. During the lifting phases, the cavities forming under the sleepers 6 are filled with ballast 5. During this, the track grid 8 is over-lifted. In the lowering phases, a consolidation of the ballast 5 which has gotten under the sleepers 6 takes place. In this manner, the track 4 is lifted into the target position by comparison by means of the measuring system 12.

The pulsing lifting-lowering motion can be tailored to the ballast condition and the desired lift. In this, the corresponding parameters such as lifting force, impact force, vibration frequency and vertical load are set by an operator. Also, pre-sets for these parameters may be stored in the control device 20.

Accompanying this, a lining of the track 4 may take place. In this, for example, the vibration of the lifting unit 10 is stopped every 1,5 to 2 meters in order to carry out a lateral displacement of the track grid 8 by means of the lining drives 19.

In a subsequent working procedure, a stabilizing unit 21 is employed. To that end, several units 10, 21 can be arranged on a machine 1, as shown in FIG. 2. Favourably, the stabilizing unit 21 can be operated with an adjustable impact force. In this case, the striking force of the stabilizing unit 21 is controlled via the measuring system 12 in such a way that possible longitudinal level faults are smoothed. Such longitudinal level faults occur in exceptional cases as a result of the pulsing lifting-lowering motion of the lifting unit 10. In addition, the ballast 5 is further consolidated by means of the stabilizing unit 21, resulting in an even higher track position quality.

With the aid of the described method, a consolidation of the ballast 5 in layers and a restoration of the track geometry for drive clearances up to a certain speed can be carried out even without the use of a tamping unit 11. Optionally, a treatment by means of a tamping machine follows as a finalizing working pass.

The invention claimed is:

1. A method for treatment of a ballast track by means of track maintenance machine which comprises:

a lifting unit comprising:

gripping rollers coupled to the lifting unit for gripping a track grid formed of rails and sleepers;

lifting drives for lifting the track grid; and lining drives by means of which the track grid is aligned, and that during a lining operation the vibration of the lifting unit is reduced;

a measuring system for comparing to a target position of the track, a vibration exciter wherein the lifting unit is set in vibration by means of said vibration exciter and the vibration is transmitted to the track grid;

a control device wherein the lifting unit is controlled by means of said control device in such a way that, during a lifting operation, the lifting unit is set in vibration, and the track grid is first lifted to above the target position and subsequently lowered to the target position.

2. The method according to claim 1, wherein the lifting operation is interrupted at least once by lowering the vibrating lifting unit.

3. The method according to claim 1, wherein in a preceding working step, ballast is placed on the track grid.

4. The method according to claim 3, wherein new or cleaned ballast is placed on the track grid.

5. The method according to claim 1, wherein in a subsequent working step, sleepers of the track grid are tamped by means of a tamping unit.

6. A track maintenance machine for treatment of a ballast track, comprising:

a lifting unit comprising:

gripping rollers coupled to the lifting unit for gripping a track grid formed of rails and sleepers;

lifting drives for lifting the track grid;

lining drives by means of which the track grid is aligned, and that during a lining operation the vibration of the lifting unit is reduced;

a measuring system for comparing to a target position of the track, a vibration exciter wherein the lifting unit is set in vibration by means of said vibration exciter and the vibration is transmitted to the track grid;

a control device wherein the lifting unit is controlled by means of said control device in such a way that, during a lifting operation, the lifting unit is set in vibration, and the track grid is first lifted to above the target position and subsequently lowered to the target position;

wherein said control device is arranged which is designed for actuation of the lifting unit as per a method according to claim 1.

7. The track maintenance machine according to claim 6, wherein the vibration exciter has an adjustment device for setting an impact force acting by the lifting unit on the track grid.

8. The track maintenance machine according to claim 6, wherein a tamping unit is arranged rearward of the lifting unit with regard to a working direction, on a machine frame or a satellite frame.

9. The track maintenance machine according to claim 6, wherein a stabilizing unit is arranged rearward of the lifting unit with regard to a working direction.

* * * * *